US008061708B2

(12) United States Patent
Fujita et al.

(10) Patent No.: US 8,061,708 B2
(45) Date of Patent: Nov. 22, 2011

(54) SHEET FEEDING DEVICE

(75) Inventors: Masahiko Fujita, Osaka (JP); Tadasu Taniguchi, Osaka (JP); Masaya Asakawa, Osaka (JP); Norichika Katsura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 70 days.

(21) Appl. No.: 12/474,542

(22) Filed: May 29, 2009

(65) Prior Publication Data

US 2009/0295063 A1 Dec. 3, 2009

(30) Foreign Application Priority Data

Jun. 2, 2008 (JP) ..... 2008-144139

(51) Int. Cl.
*B65H 1/00* (2006.01)

(52) U.S. Cl. ..... 271/171; 271/145; 399/389; 399/393

(58) Field of Classification Search ..... 271/171, 271/145; 399/389, 393
See application file for complete search history.

(56) References Cited

U.S. PATENT DOCUMENTS

| | | | | |
|---|---|---|---|---|
| 4,697,803 | A * | 10/1987 | Kan et al. | 271/127 |
| 4,786,042 | A * | 11/1988 | Stemmle | 271/9.1 |
| 6,254,085 | B1 * | 7/2001 | Kang | 271/171 |
| 7,144,007 | B2 * | 12/2006 | Kim | 271/171 |
| 7,694,960 | B2 * | 4/2010 | Sing | 271/171 |
| 2010/0117291 | A1 * | 5/2010 | Bridges et al. | 271/171 |

FOREIGN PATENT DOCUMENTS

| | | | |
|---|---|---|---|
| JP | 60-242139 | A | 12/1985 |
| JP | 06-127704 | A | 5/1994 |
| JP | 07-002386 | A | 1/1995 |
| JP | 07-251951 | A | 10/1995 |
| JP | 11-079418 | A | 3/1999 |
| JP | 11-139572 | | 5/1999 |
| JP | 11-165881 | | 6/1999 |
| JP | 2002-096933 | A | 4/2002 |

* cited by examiner

*Primary Examiner* — Stefanos Karmis
*Assistant Examiner* — Luis A Gonzalez
(74) *Attorney, Agent, or Firm* — Renner, Otto, Boisselle & Sklar, LLP

(57) ABSTRACT

A sheet feeding device includes a sheet support, a restricting portion, a displacement section, and a link section. The restricting portion slides along a line passing through restricting points. The restricting portion restricts the position of the sheet when the restricting portion is positioned at each of the restricting points. The link section interlinks the restricting portion and the displacement section. The position of the displacement section is detected. The link section, which interlinks the restricting section and the displacement section, is configured to change a ratio of a distance that the displacement section travels as the restricting section travels a fixed distance, wherein the ratio of the distance between those restricting points which define a relatively large spacing therebetween becomes longer than the ratio of the distance between those restricting points which define a relatively small spacing therebetween.

7 Claims, 17 Drawing Sheets

Fig.4

| | A4 SHEET | LETTER SHEET | B5 SHEET |
|---|---|---|---|
| 22A | OFF | ON | ON |
| 22B | OFF | OFF | ON |
| 22C | OFF | OFF | OFF |

SHEET FEEDING DEVICE

CROSS REFERENCE

This Nonprovisional application claims priority under 35 U.S.C. §119(a) on Patent Application No. 2008-144139 filed in Japan on Jun. 2, 2008, the entire contents of which are hereby incorporated by reference.

BACKGROUND OF THE INVENTION

The present invention relates to a sheet feeding device for feeding recording sheets to a copier or the like.

A sheet feeding device of a certain type includes a restricting section, a displacement section, and a link section and identifies the size of a recording sheet placed on a sheet support (see Japanese Patent Laid-Open Publication No. HEI 11-139572). The restricting section restricts the position of the recording sheet placed on the sheet support by abutting against an edge of the recording sheet. The link section interlinks the restricting section and the displacement section to displace the displacement section in accordance with a sliding movement of the restricting section. The position of the displacement section is detected by a sensor.

Japan and European countries generally adopt ISO•JIS as industrial standards for recording sheets, while North American countries generally adopt International Standards. Sizes of recording sheets conforming to ISO•JIS include A4 size and B5 size. Sizes of recording sheets conforming to International Standards include letter size and legal size. A4 size is 210×297 mm. B5 size is 182×257 mm. Letter size is 215.9×279.4 mm. Legal size is 215.9×355.6 mm.

A standard sheet of A4 size (hereinafter will be referred to as "A4 sheet"), a standard sheet of letter size (hereinafter will be referred to as "letter sheet") and a standard sheet of B5 size (hereinafter will be referred to as "B5 sheet") have their respective long side dimensions which are approximate to each other. The difference in long side dimension between A4 sheet and letter sheet is smaller than the difference in long side dimension between letter sheet and B5 sheet. For this reason, a sheet feeding device meeting both of ISO•JIS and International Standards is likely to cause an error in identifying the sizes of A4 sheet and letter sheet. If the linkage between the displacement section and the restricting section is highly precise and, at the same time, the resolution of the sensor is high, the sheet feeding device mentioned above can realize size identification with high precision. However, some levels of dimensional precision of each of the restricting section, gear member and displacement section make it difficult to link the position of the displacement section to that of the restricting section.

A feature of the present invention is to provide a sheet feeding device capable of identifying the sizes of standard sheets with high precision irrespective of the level of dimensional precision of each of the restricting section, gear member and displacement section.

SUMMARY OF THE INVENTION

A sheet feeding device according to the present invention includes a sheet support, a restricting section, a displacement section, and a link section. A recording sheet is placed on the sheet support. The restricting section slides along a line passing through at least three restricting points on the sheet support. The restricting section restricts the position of the recording sheet by abutting against an edge of the recording sheet when the restricting section is positioned at each of the restricting points. The displacement section is provided with the sheet support, and the position of the displacement section is detected by a sensor. The link section, which interlinks the restricting section and the displacement section, is configured to change a ratio of a distance that the displacement section travels as the restricting section travels a fixed distance, wherein the ratio of the distance between those restricting points which define a relatively large spacing therebetween becomes longer than the ratio of the distance between those restricting points which define a relatively small spacing therebetween.

The foregoing and other features and attendant advantages of the present invention will become more apparent from the reading of the following detailed description of the invention in conjunction with the accompanying drawings.

BRIEF DESCRIPTION OF THE DRAWINGS

FIG. 4 is a table showing the relationship between positions of the switches and classifications of standard sheets;

DETAILED DESCRIPTION OF THE INVENTION

Figure 1:
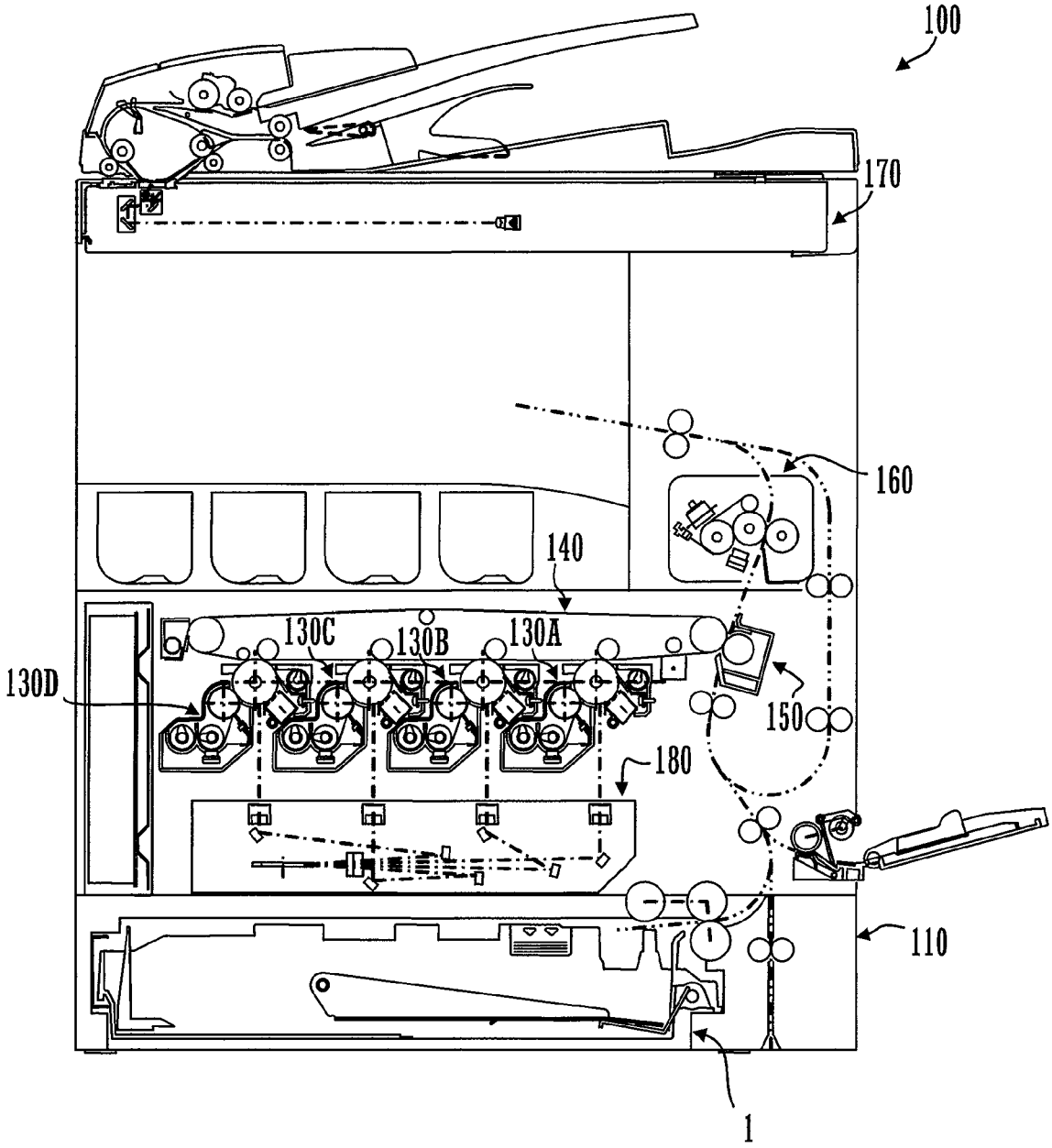
FIG. 1 is a schematic front elevational view showing a copier provided with a sheet feeding device according to a first embodiment of the present invention.

Hereinafter, a sheet feeding device according to a first embodiment of the present invention will be described based on a copier provided with the sheet feeding device. FIG. 1 is a schematic front elevational view showing a copier according to the present embodiment.

A copier 100 forms a color or monochrome image in accordance with image data on a recording sheet by using four color (i.e., yellow, magenta, cyan and black) developers of a two-component system.

The copier 100 includes a sheet feed unit 110, image forming units 130A to 130D, a laser scanning unit (LSU) 180, an intermediate transfer unit 140, a secondary transfer unit 150, a fixing unit 160, and a document reading unit 170.

The document reading unit 170 reads color image data from a document placed on a platen. The color image data is color-separated into simple color image data items corresponding to respective of cyan, magenta, yellow and black by a non-illustrated image processing section. The LSU 180 applies laser beams to the image forming units 130A to 130D in accordance with the respective simple color image data items. The image forming units 130A to 130D form toner images of the respective colors. The intermediate transfer unit 140 includes an endless intermediate transfer belt. The toner images are transferred from the image forming units 130A to 130D to the intermediate transfer belt. The sheet feed unit 110 feeds each of recording sheets accommodated therein to the secondary transfer unit 150. The secondary transfer unit 150 transfers a resulting toner image from the intermediate transfer belt to a recording sheet. The fixing unit 160 fixes the toner image onto the recording sheet by heat.

The sheet feed unit 110, which is equivalent to the sheet feeding device defined by the present invention, includes a sheet feed cassette 1. The sheet feed cassette 1 accommodates therein standard sheets of any one of the types including A4 sheet, B5 sheet and letter sheet.

Figure 2A:
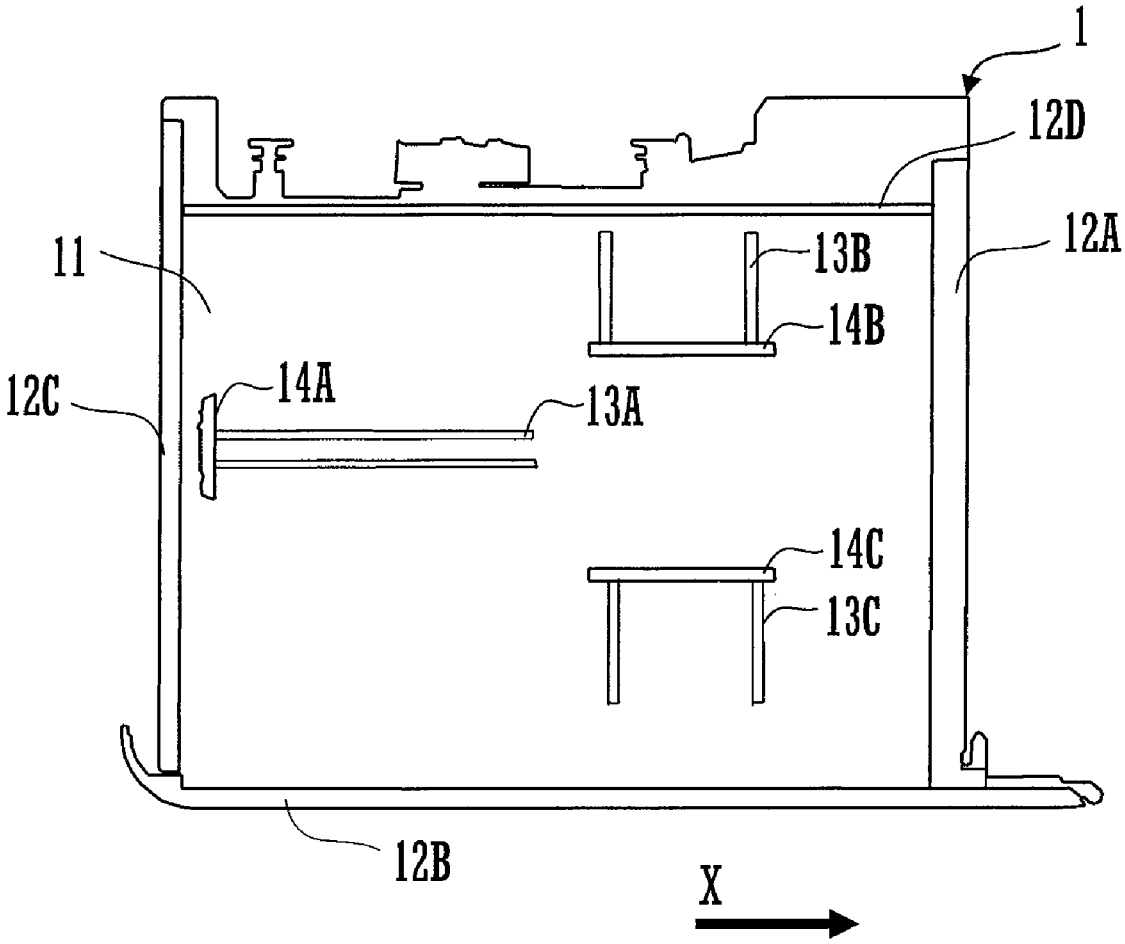
FIG. 2A is a schematic plan view showing a sheet feed cassette included in the sheet feeding device.

FIG. 2A is a schematic plan view of the sheet feed cassette 1. In FIG. 2A, the arrow indicates a sheet feed direction X toward a right-hand side surface of the sheet feeding device.

The sheet feed cassette 1 includes a sheet support 11, wall portions 12A to 12D, slot portions 13A to 13C, and restricting portions 14A to 14C. The sheet support 11 is shaped like a rectangular flat plate. The wall portion 12A extends along a side of the sheet support 11 which extends perpendicular to the sheet feed direction X and which lies on the side closer to the right-hand side surface of the device. The wall portion 12B extends along a side of the sheet support 11 which extends parallel with the sheet feed direction X and which lies on the side closer to a front side surface of the device. The wall portion 12C extends along a side of the sheet support 11 which extends perpendicular to the sheet feed direction X and which lies on the side closer to a left-hand side surface of the device. The wall portion 12D extends along a side of the sheet support 11 which extends parallel with the sheet feed direction X and which lies on the side closer to a rear side surface of the device. The slot portion 13A is vertically cut through the sheet support 11 and linearly shaped to extend parallel with the sheet feed direction X. The slot portions 13B and 13C are open on an upper surface of the sheet support 11 and are linearly shaped to extend perpendicular to the sheet feed direction X. The restricting portion 14A, which is equivalent to the restricting section defined by the present invention, is mounted so as to be slidable along the slot portion 13A. The restricting portion 14B is mounted so as to be slidable along the slot portion 13B. The restricting portion 14C is mounted so as to be slidable along the slot portion 13C.

When the restricting portion 14A restricts the position of a standard sheet by abutting against a short side of an A4 sheet, the restricting portion 14A is positioned at a first restricting point spaced about 297 mm from the wall portion 12A, while the restricting portions 14B and 14C positioned as spaced about 210 mm from each other. When the restricting portion 14A restricts the position of a standard sheet by abutting against a short side of a letter sheet, the restricting portion 14A is positioned at a second restricting point spaced about 280 mm from the wall portion 12A, while the restricting portions 14B and 14C positioned as spaced about 216 mm from each other. When the restricting portion 14A restricts the position of a standard sheet by abutting against a short side of a B5 sheet, the restricting portion 14A is positioned at a third restricting point spaced about 257 mm from the wall portion 12A, while the restricting portions 14B and 14C positioned as spaced about 182 mm from each other.

The restricting portion 14A may be configured to be capable of restricting standard sheets of other sizes, such as legal size, also. The restricting portion 14A may be configured to abut against a long side of a standard sheet in order to restrict the position of the standard sheet. It is preferable that at least three restricting points defining adjacent spacings therebetween which are not equal to each other are established to restrict standard sheets.

Figure 2B:
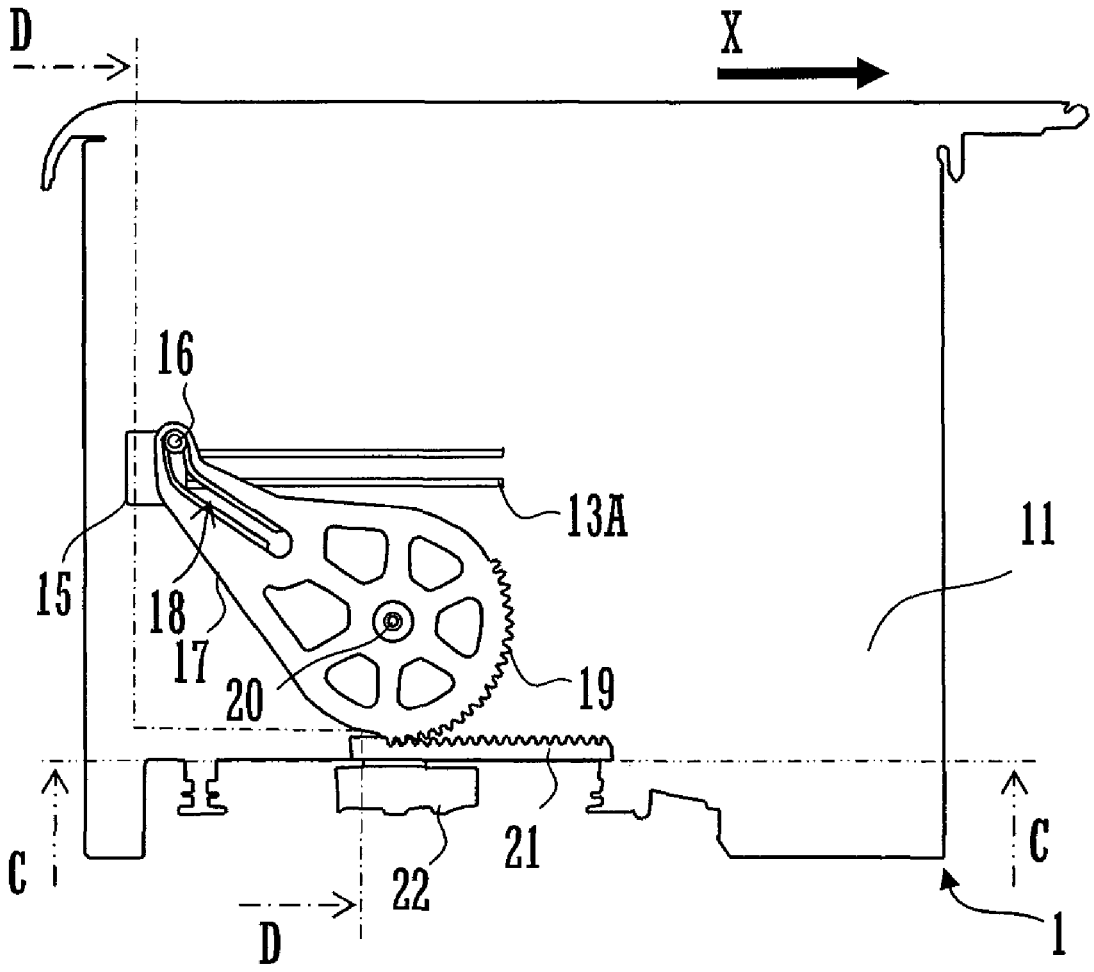
FIG. 2B is a schematic bottom view of the sheet feed cassette.

FIG. 2B is a schematic bottom view of the sheet feed cassette 1.

The sheet feed cassette 1 includes a gear member 17, a slider 15 and a rack 21 which are disposed on the bottom side of the sheet support 11.

The gear member 17, which is equivalent to the link section defined by the present invention, has a teardrop outside shape as can be obtained by combining a semicircular shape and a substantially triangular shape. The semicircular portion has a toothed peripheral surface 19, while the triangular portion defines a slit 18 therein. The gear member 17 is supported by a rotating shaft 20 extending through the center of the semicircular portion from a lower surface of the sheet support 11.

The slider 15 is joined to the restricting portion 14A through the slot portion 13A and is slidable along the slot portion 13A with movement of the restricting portion 14A. The slider 15 has a slider pin 16. The slider pin 16 is fitted in the slit 18 of the gear member 17 to form a sliding structure. As the restricting portion 14 slides, the slider pin 16 slides in the slit 18 of the gear member 17 with movement of the slider 15, so that a component of a force exerted by the slider pin 16 on the internal wall of the slit 18 works as a torque to cause the gear member 17 to pivot about the rotating shaft 20. The slider 15 and the slot portion 13A are located substantially centrally of the sheet feed cassette 1 so as to provide a space around the sliding structure for preventing the tip of the gear member 17 from interfering with peripheral members.

Figure 2C:
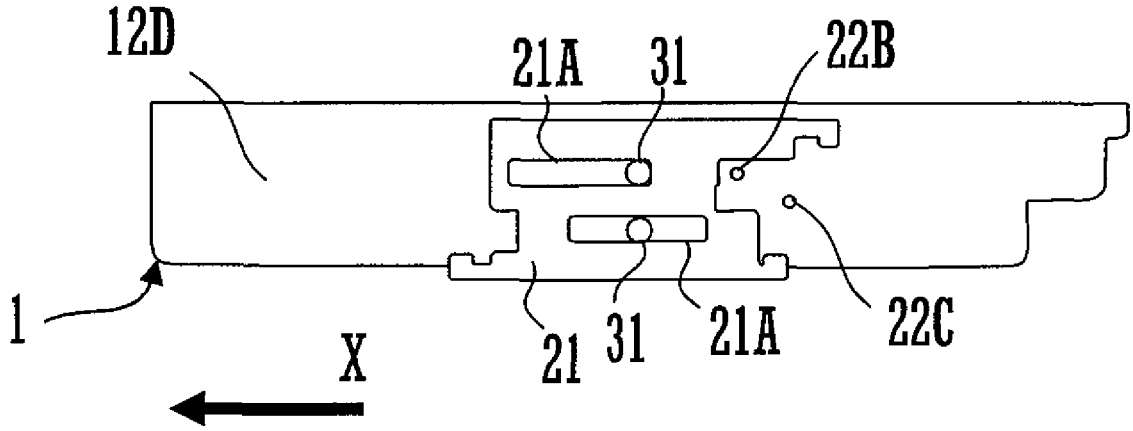
FIG. 2C is a schematic side elevational view showing a side of the sheet feed cassette indicated by a dashed double-dotted line of FIG. 2B.

FIG. 2C is a schematic side elevational view showing a side of the sheet feed cassette 1 indicated by a dashed double-dotted line as viewed in the direction of arrows C of FIG. 2B.

The rack 21, which is equivalent to the displacement section defined by the present invention, has a portion projecting downwardly from a bottom surface of the sheet feed cassette 1 and formed with a toothed surface (not shown) meshing with the toothed peripheral surface 19 of the gear member 17. The rack 21, together with the gear member 17, forms a rack and pinion mechanism. The rack 21 has a rack slot 21A extending parallel with the sheet feed direction. The rack slot 21A is fitted over a pin 31 projecting laterally from the wall portion 12D. Therefore, the rack 21 is slidable along the sheet feed direction parallel with the slot portion 13A. As the gear member 17 pivots clockwise, the rack 21 slides in the direction opposite to the sheet feed direction. As the gear member 17 pivots counterclockwise, the rack 21 slides in the sheet feed direction. Since the rack and pinion mechanism has a very small backlash, the position of the rack 21 follows varying angle of the gear member 17 with high precision.

Figure 2D:
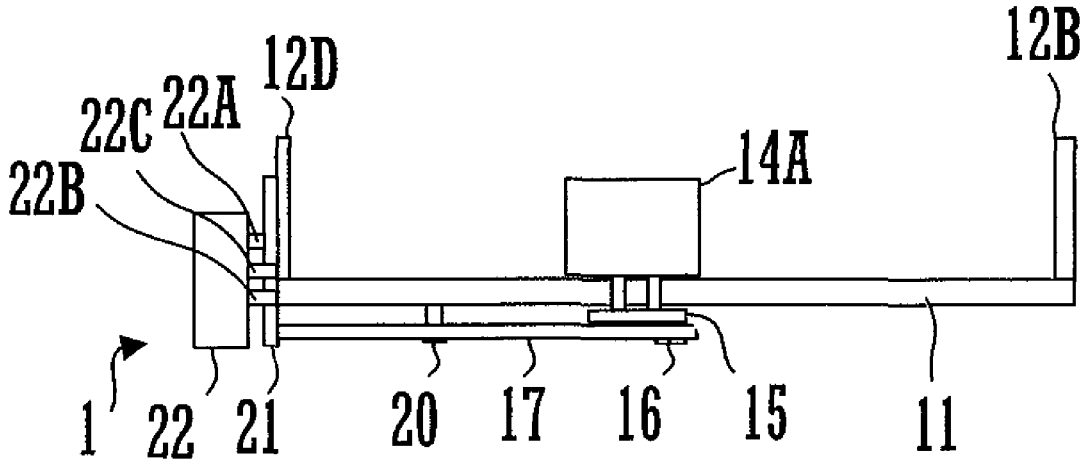
FIG. 2D is a schematic side elevational view showing a side of the sheet feed cassette indicated by a dashed dotted line of FIG. 2B.

FIG. 2D is a schematic side elevational view showing a side of the sheet feed cassette 1 indicated by a dashed dotted line as viewed in the direction of arrows D of FIG. 2B.

A sensor 22 is provided on the housing of the copier 100 and includes switches 22A to 22C on a track on which the rack 21 slides. When the rack 21 contacts any one of the switches 22A to 22C, the switch contacted by the rack 21 is pressed into the sensor 22. The sensor 22 outputs standard size detection signals in accordance with positions of the switches 22A to 22C pressed in or not. Such a standard size detection signal is outputted to a control section of the copier 100, which in turn performs a control meeting the standard size of a recording sheet thus detected.

Figure 3:
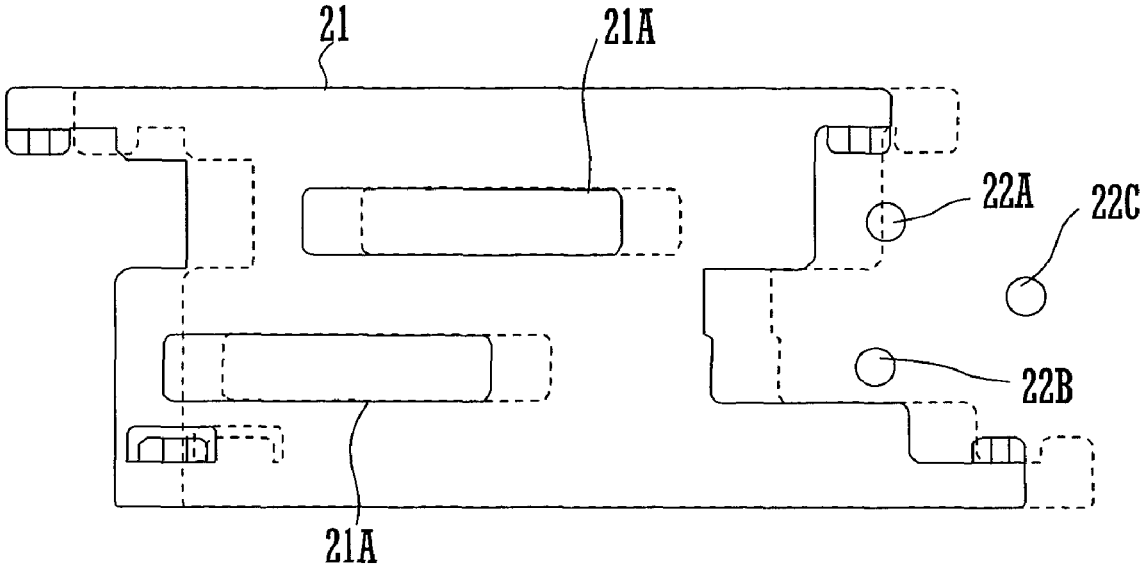
FIG. 3 is a view illustrating the positional relationship between a rack included in the sheet feed cassette and switches of a sensor for detecting the position of the rack.

FIG. 3 is a view illustrating the positional relationship between the rack 21 and the switches 22A to 22C. In FIG. 3, the solid line depicts the rack 21 in a position assumed when the restricting portion 14A restricts the position of an A4 sheet, while the dashed line depicts the rack 21 in a position assumed when the restricting portion 14A restricts the position of a letter sheet.

FIG. 4 is a table showing the relationship between positions of the switches and classifications of standard sheets.

When the rack 21 is in the position assumed when the restricting portion 14A restricts the A4 sheet, the rack 21 does not contact any one of the switches 22A to 22C and, hence, all the switches 22A to 22C are in their positions projecting from the sensor 22. When the switches 22A to 22C assume these positions, the sensor 22 outputs a standard size detection signal indicative of A4 size to the control section of the copier 100.

When the rack 21 is in the position assumed when the restricting portion 14A restricts the letter sheet, the rack 21 contacts the switch 22A and fails to contact the switches 22B and 22C and, hence, only the switch 22A is pressed into the sensor 22 while the other switches 22B and 22C are in their positions projecting from the sensor 22. When the switches 22A to 22C assume these positions, the sensor 22 outputs a standard size detection signal indicative of letter size to the control section of the copier 100.

When the rack 21 is in the position assumed when the restricting portion 14A restricts a B5 sheet, the rack 21 contacts the switches 22A and 22B and, hence, the switches 22A and 22B are pressed into the sensor 22 while the switch 22C is in its position projecting from the sensor 22. When the switches 22A to 22C assume these positions, the sensor 22 outputs a standard size detection signal indicative of B5 size to the control section of the copier 100.

When the rack 21 is in the position in which the rack 21 contacts all the switches 22A to 22C, all the switches 22A to 22C are in their positions pressed into the sensor 22. When the switches 22A to 22C assume these positions, the sensor 22 outputs to the control section of the copier 100 a standard size detection signal indicating that a sheet of A4 size is placed in a portrait orientation with its long side contacted by the restricting portion 14A.

Figure 5:
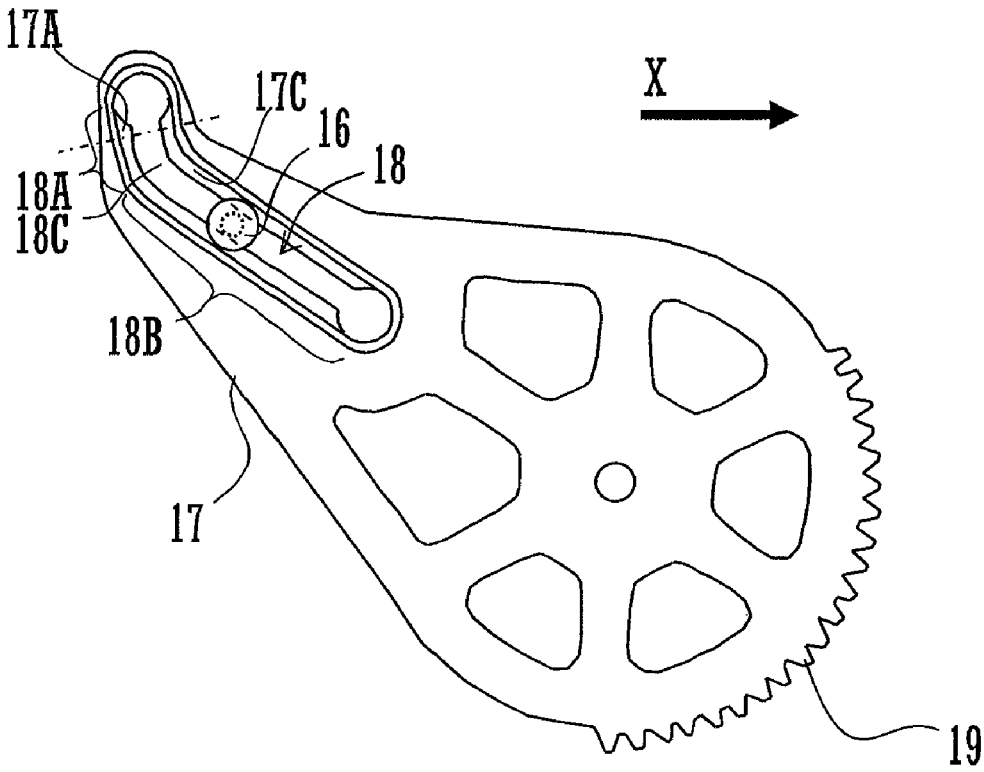
FIG. 5 is a schematic bottom view showing a gear member included in the sheet feed cassette.

FIG. 5 is a schematic bottom view of the gear member 17.

The gear member 17 has a plurality of punched portions around a rotating shaft bearing for reducing the weight thereof. The slit 18 of the gear member 17 includes a region 18A on the outer peripheral side and a region 18B on the inner peripheral side. The regions 18A and 18B are joined to each other in a bending fashion at a bending position 18C. The region 18B is a linear region extending along a peripheral surface of the gear member 17. The region 18A is a linear region extending outwardly from the bending position 18C toward an outer peripheral surface in a direction inclined relative to the circumferential direction.

Figure 6:
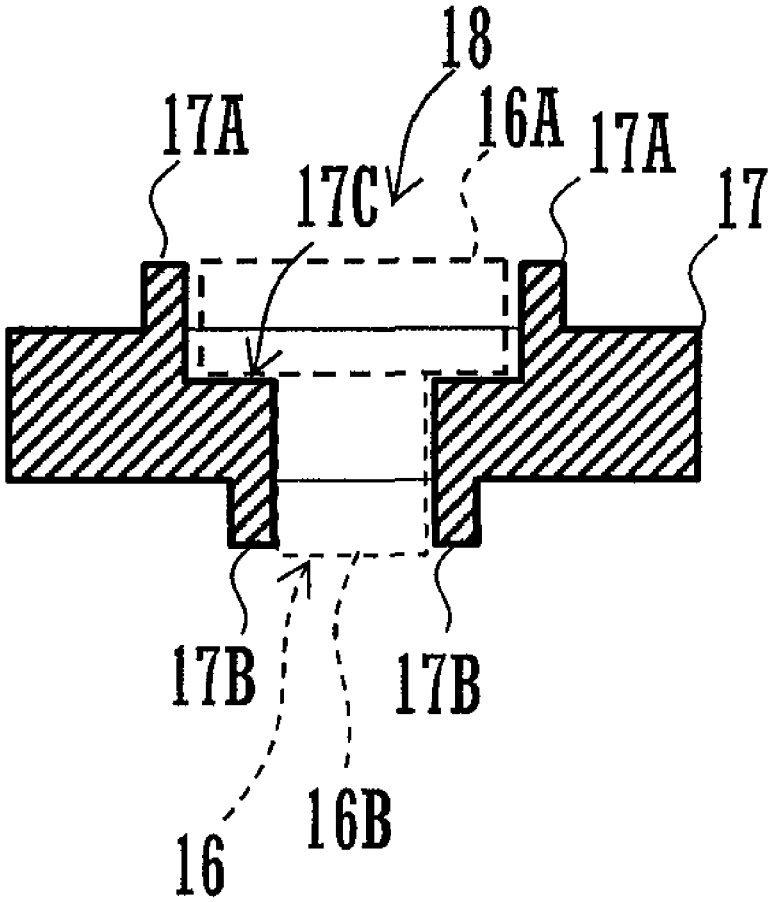
FIG. 6 is a schematic sectional view of the gear member.

FIG. 6 is a schematic sectional view, taken on a dashed dotted line of FIG. 5, of the gear member 17.

The slit 18 has ribs 17A and 17B. The ribs 17A and 17B enhance the strength of the periphery of the slit 18 to prevent the gear member 17 from being broken. The slider pin 16 has a sectional shape with a large-diameter portion 16A and a small-diameter portion 16B. The slit 18 has a sectional shape similar to that of the slider pin 16. This feature ensures a sufficient contact area between the slider pin 16 and the slit 18, thereby inhibiting rattling of the slider pin 16 against the inner wall of the slit 18.

Figure 7A:
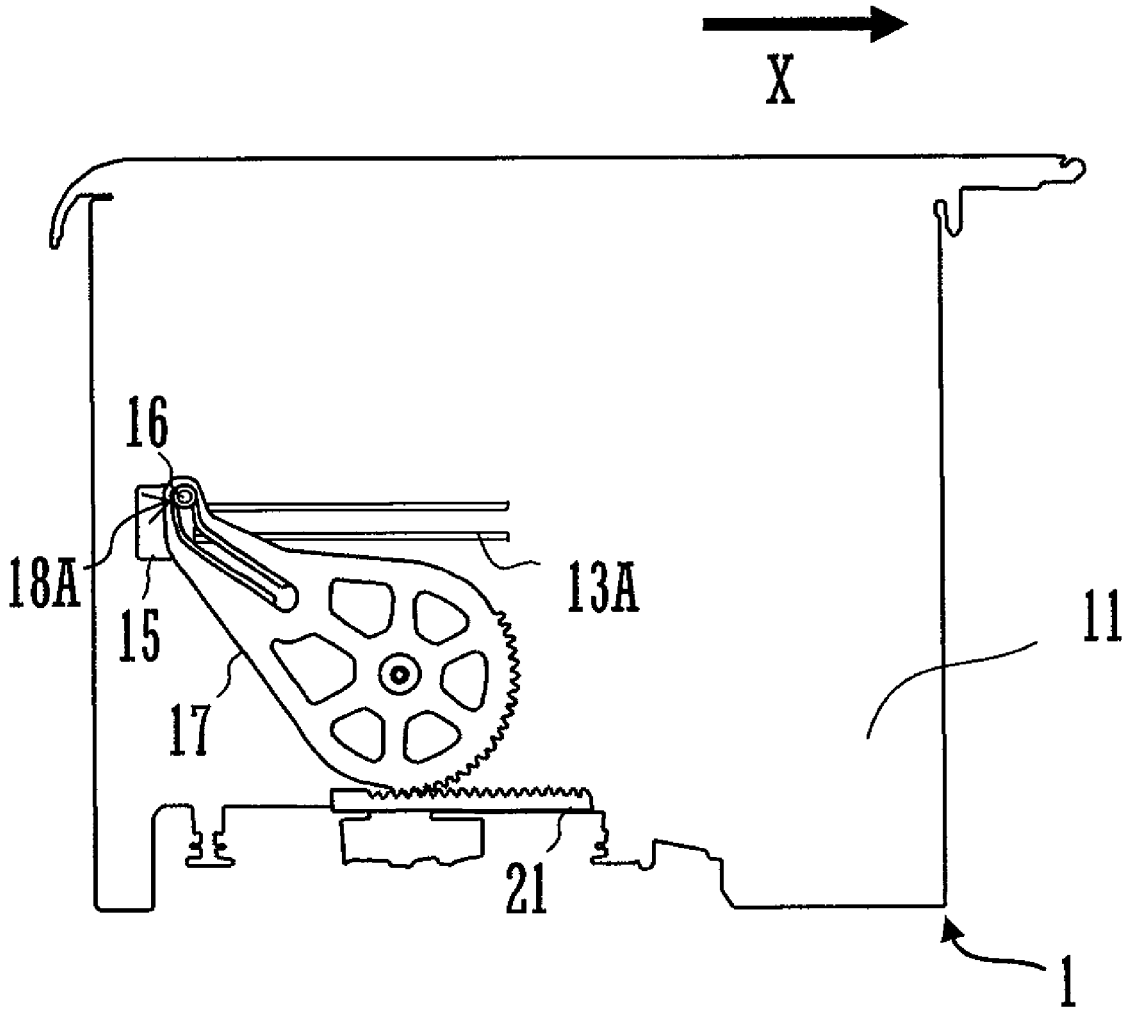
FIG. 7A is a view illustrating the gear member in a state assumed when A4 sheets are placed in the sheet feed cassette.

FIG. 7A is a view illustrating the gear member 17 in a state assumed when A4 sheets are placed in the sheet feed cassette 1. When A4 sheets are placed in the sheet feed cassette 1, the restricting portion 14A and the slider 15 are positioned at the first restricting point in the slot portion 13A. At that time, the gear member 17 has pivoted to assume an orientation at an angle such as to position the slider pin 16 in the region 18A, while the rack 21 is positioned at an extremity of its slidable range which lies on the side closer to the right-hand side surface of the device.

Figure 7B:
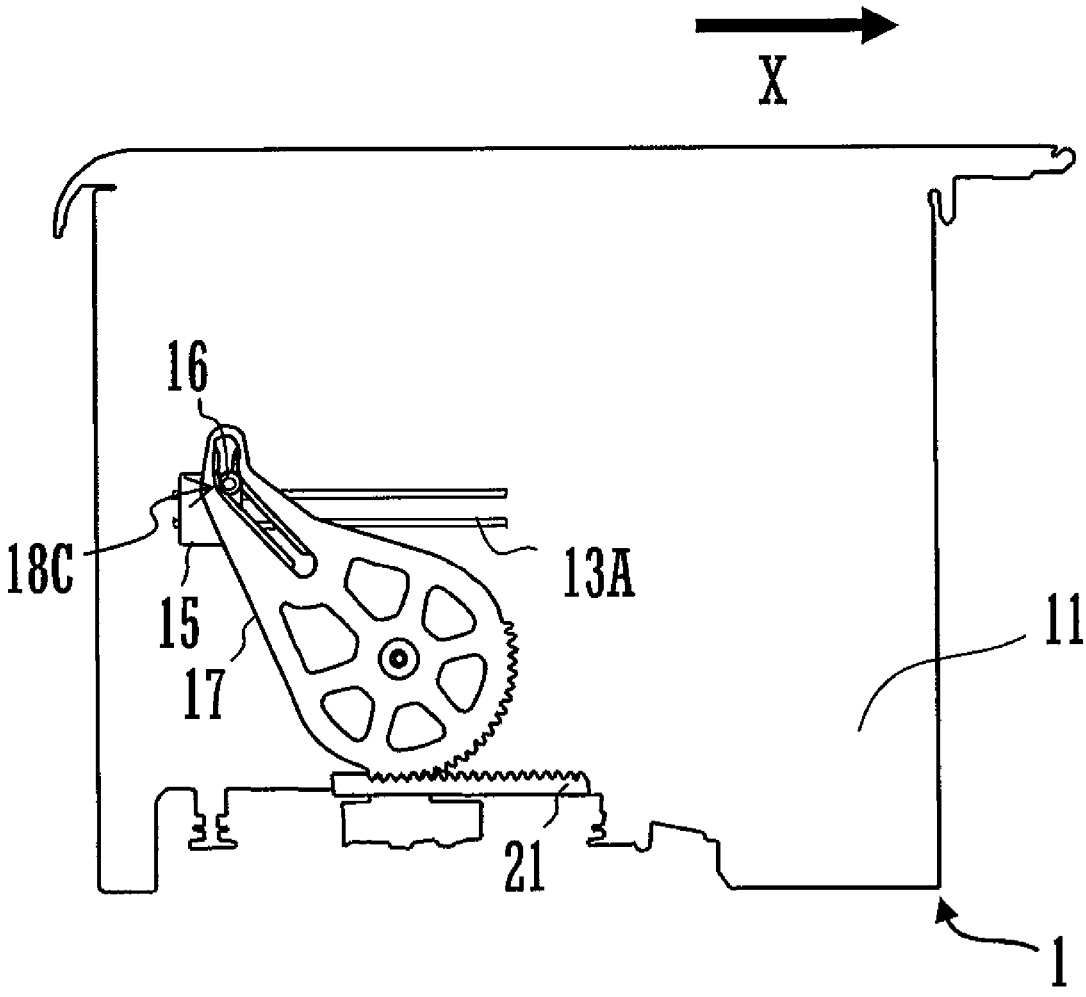
FIG. 7B is a view illustrating the gear member in a state assumed when letter sheets are placed in the sheet feed cassette.

FIG. 7B is a view illustrating the gear member 17 in a state assumed when letter sheets are placed in the sheet feed cassette 1. When letter sheets are placed in the sheet feed cassette 1, the restricting portion 14A and the slider 15 are positioned at the second restricting point in the slot portion 13A. The second restricting point in the slot portion 13A is located closer to the right-hand side surface of the device than the first restricting point in the slot portion 13A. At that time, the gear member 17 has pivoted to assume an orientation at an angle such as to position the slider pin 16 at the bending position 18C, while the rack 21 is positioned closer to the left-hand side surface of the device than the position thereof shown in FIG. 7A.

Figure 7C:
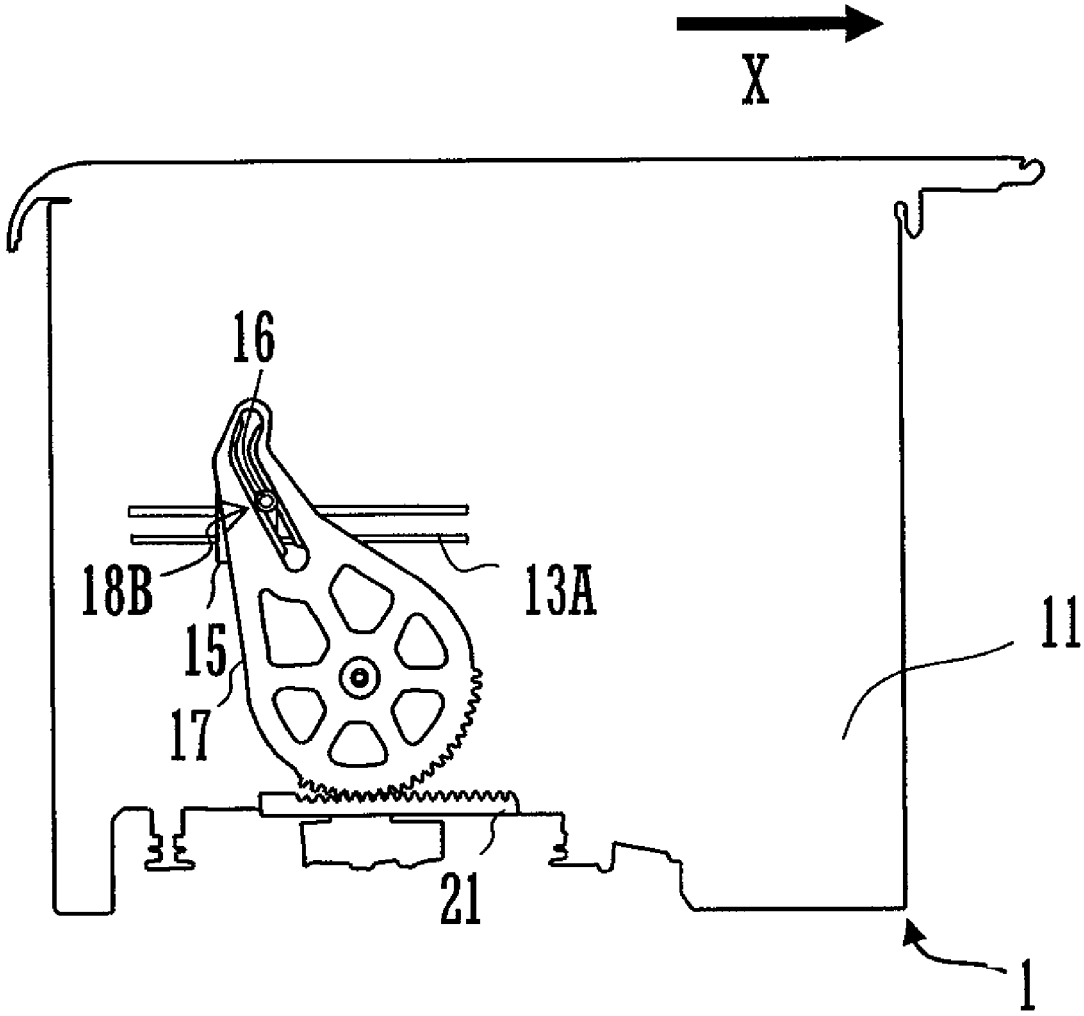
FIG. 7C is view illustrating the gear member in a state assumed when B5 sheets are placed in the sheet feed cassette.

FIG. 7C is view illustrating the gear member 17 in a state assumed when B5 sheets are placed in the sheet feed cassette 1. When B5 sheets are placed in the sheet feed cassette 1, the restricting portion 14A and the slider 15 are positioned at the third restricting point in the slot portion 13A. The third restricting point in the slot portion 13A is located closer to the right-hand side surface of the device than the second restricting point in the slot portion 13A. At that time, the gear member 17 has pivoted to assume an orientation at an angle such as to position the slider pin 16 substantially centrally of the region 18B, while the rack 21 is positioned closer to the left-hand side surface of the device than the position thereof shown in FIG. 7B.

Figure 8A:
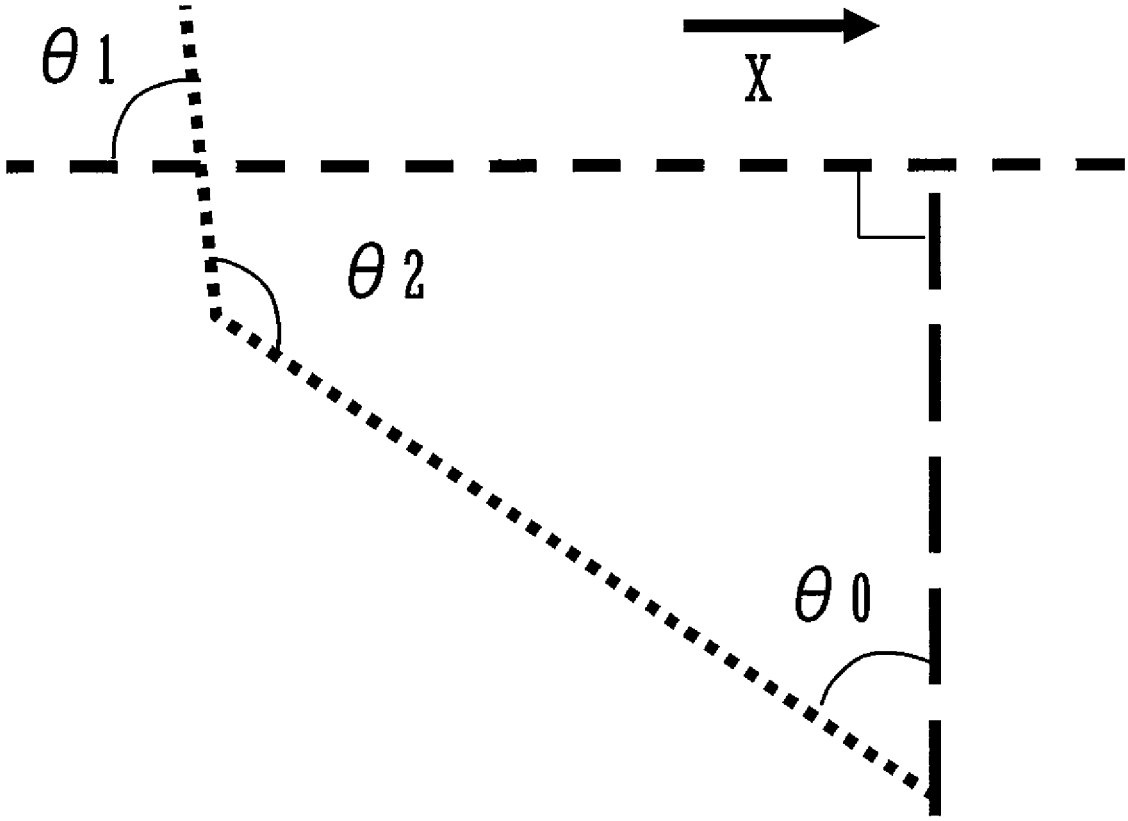
FIG. 8A is a diagram illustrating a first example of angles formed between the gear member and peripheral structures.

FIG. 8A is a diagram schematically illustrating a first example of angles formed between the gear member 17 and peripheral structures. In FIG. 8A, the dotted line indicates the center line of the slit 18; the dashed line indicates the center line of the slot portion 13A; and the long dashed line indicates a line perpendicular to the slot portion 13A.

In FIG. 8A, angle θ0 is an angle formed between the center line of the slit 18 and the perpendicular line when the slider pin 16 slides in the region 18A; angle θ1 is an angle formed between the center line of the slit 18 and the center line of the slot portion 13A when the slider pin 16 slides in the region 18A; and angle θ2 is the angle of the corner formed between the regions 18A and 18B.

The angles θ0 to θ2 have the following relationship:

$$\theta 0=360-90-\theta 1-\theta 2.$$

Figure 8B:
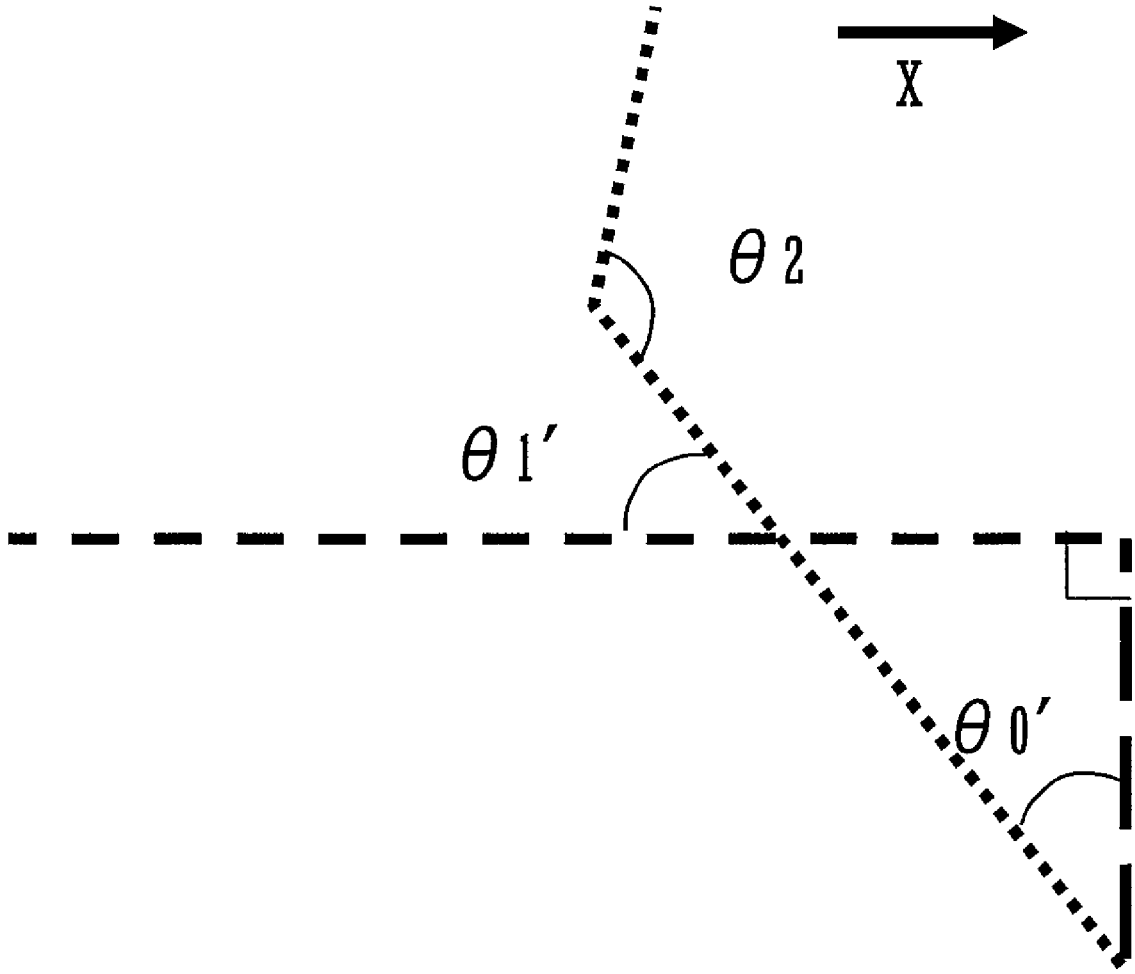
FIG. 8B is a diagram illustrating a second example of angles formed between the gear member and the peripheral structures.

FIG. 8B is a diagram schematically illustrating a second example of angles formed between the gear member 17 and the peripheral structures. In FIG. 8B, the dotted line indicates the center line of the slit 18; the dashed line indicates the center line of the slot portion 13A; and the long dashed line indicates a line perpendicular to the slot portion 13A.

In FIG. 8B, angle θ0' is an angle formed between the center line of the slit 18 and the perpendicular line when the slider pin 16 slides in the region 18B; and angle θ1' is an angle formed between the center line of the slit 18 and the center line of the slot portion 13A when the slider pin 16 slides in the region 18B.

The angles θ0' and θ1' have the following relationship:

$$\theta 0' = 180 - 90 - \theta 1'.$$

The angle θ1 formed when the slider pin 16 slides in the region 18A is closer to a right angle than the angle θ1' formed when the slider pin 16 slides in the region 18B. Therefore, even when the restricting portion 14 travels the same distance in the slot portion 13A, the angle through which the gear member 17 pivots when the slider pin 16 slides in the region 18A is larger than the angle through which the gear member 17 pivots when the slider pin 16 slides in the region 18B. On the other hand, when the gear member 17 pivots through a fixed angle, the distance that the rack 21 travels is constant. Therefore, even when the restricting portion 14 travels the same distance in the slot portion 13A, the distance that the rack 21 travels as the slider pin 16 slides in the region 18A becomes longer than the distance that the rack 21 travels as the slider pin 16 slides in the region 18B.

The slit 18 is preferably bent such that the angle at which the slit 18 and the slot portion 13A cross each other when the restricting portion 14A travels between those restricting points which define a relatively small spacing therebetween is closer to a right angle than the angle at which the slit 18 and the slot portion 13A cross each other when the restricting portion 14A travels between those restricting points which define a relatively large spacing therebetween.

In the present embodiment, the angle θ2 at which the slit 18 is bent is preferably within a range from about 120° to about 135°. When the angle θ2 is too small, the resistance to sliding of the restricting portion 14A becomes so large that smooth sliding of the restricting portion 14A is difficult. When the angle θ2 is too close to 180°, the variation in the angle θ1 (or θ1') which occurs as the slider pin 16 slides around the corner of the slit 18 is so small that the distance that the rack 21 can travel is difficult to prolong.

Figure 9A:
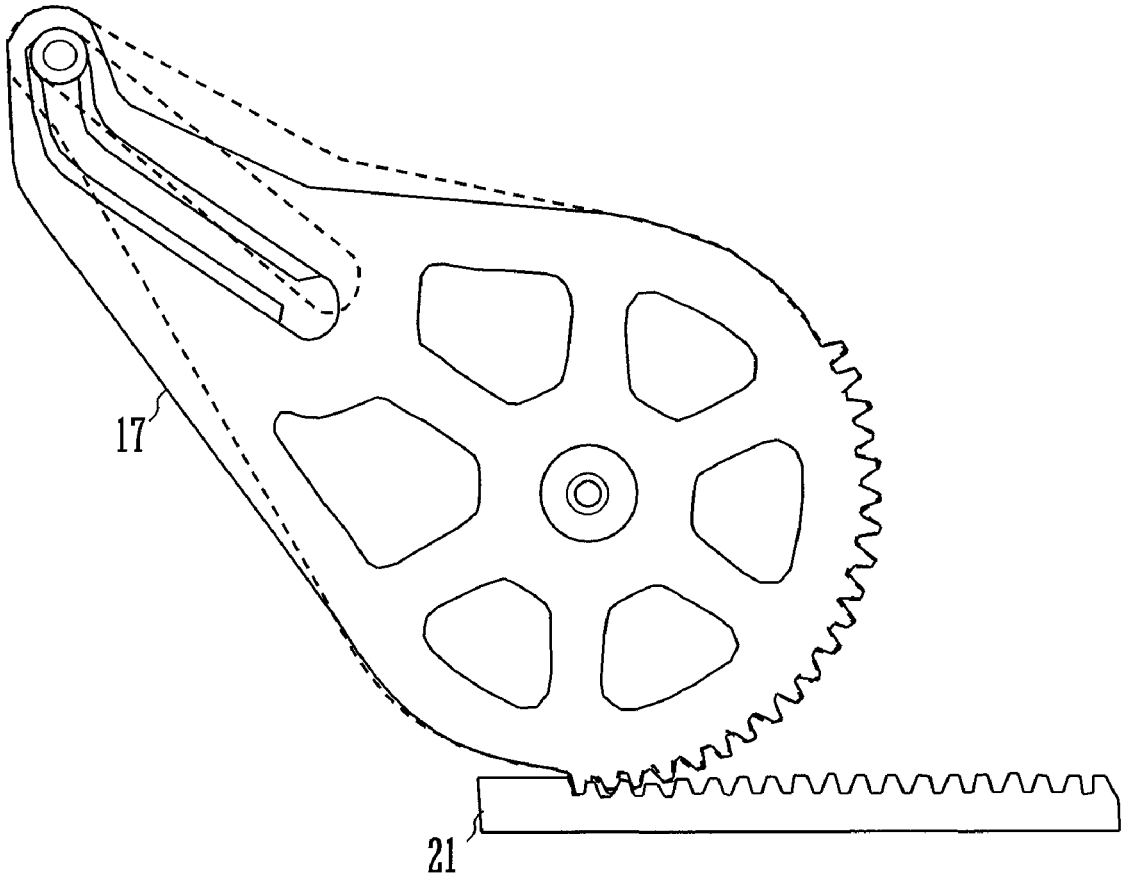
FIG. 9A is a view illustrating the state of the gear member and the state of a comparative example which are assumed when A4 sheets are placed in the sheet feed cassette.

FIG. 9A is a view illustrating the state of the gear member 17 and the state of a comparative example having a straight slit which are assumed when A4 sheets are placed in the sheet feed cassette 1. In FIG. 9A, the dashed line depicts the comparative example and the solid line depicts the gear member 17 of the present embodiment.

Figure 9B:
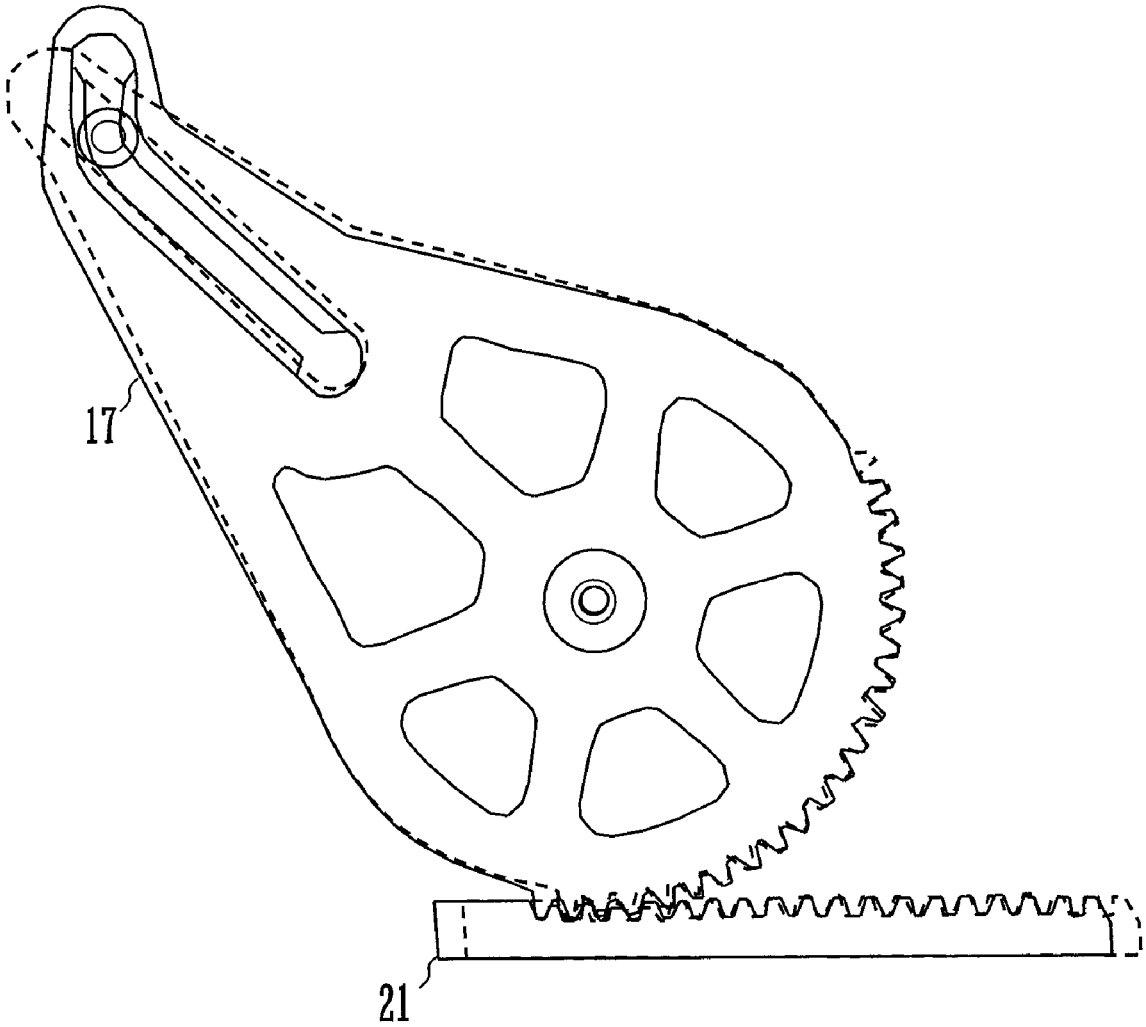
FIG. 9B is a view illustrating the state of the gear member and the state of the comparative example which are assumed when letter sheets are placed in the sheet feed cassette.

FIG. 9B is a view illustrating the state of the gear member 17 and the state of the comparative example having the straight slit which are assumed when letter sheets are placed in the sheet feed cassette 1. In FIG. 9B, the dashed line depicts the comparative example and the solid line depicts the gear member 17 of the present embodiment.

When the restricting portion 14A travels between the first and second restricting points in the slot portion 13A, the gear member 17 of the present embodiment pivots through a larger angle than in the conventional art. For this reason, the rack 21 travels a longer distance than in the conventional art. Therefore, the rack 21 of the present embodiment can be located farther from the switch 22A than in the conventional art. By so doing, it is possible to reduce the danger of erroneously detecting the sizes of standard sheets even when there are variations in the dimensional precision of the members associated to each other.

Description will be made of a second embodiment of the present invention.

Figure 10:
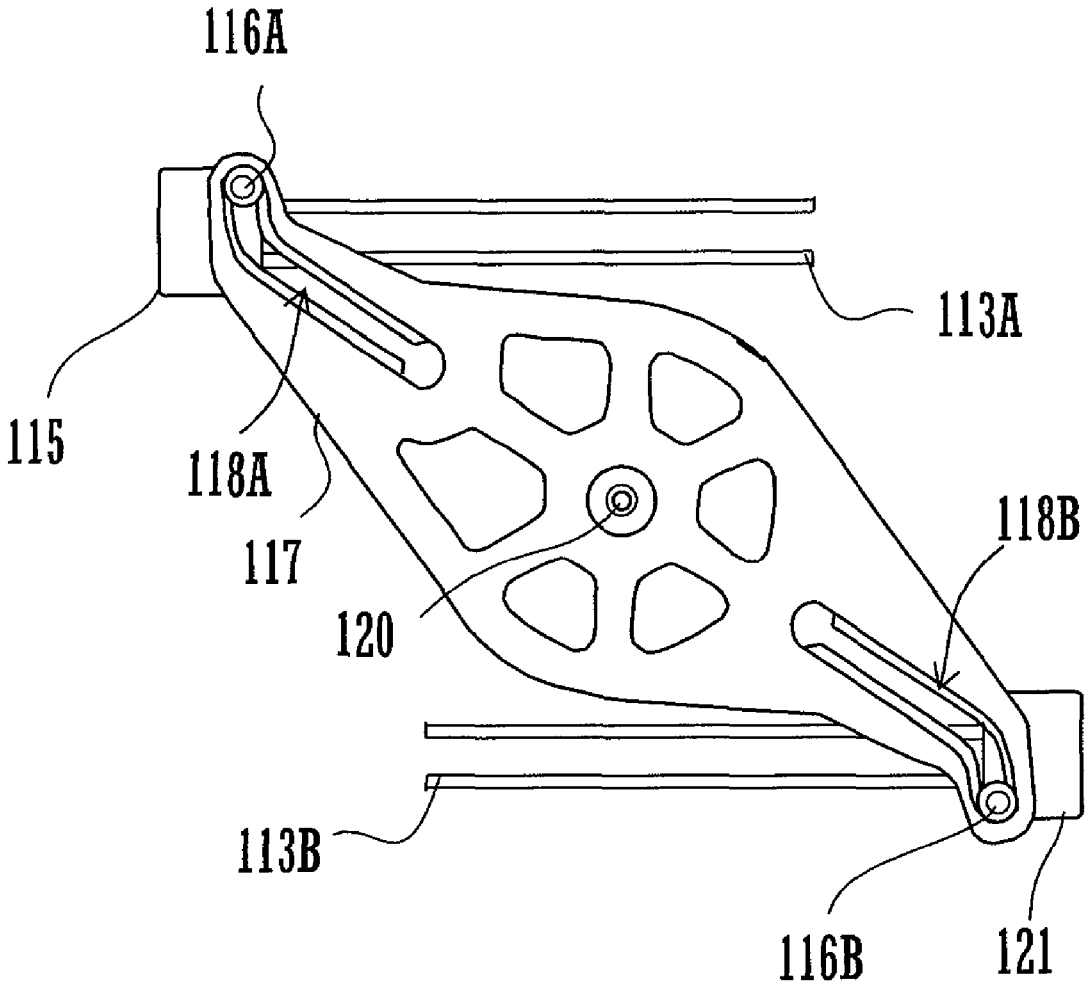
FIG. 10 is a view illustrating an arrangement of a sheet feed cassette included in a sheet feeding device according to a second embodiment of the present invention.

FIG. 10 is a bottom view illustrating an exemplary link structure according to the present embodiment. Though the foregoing embodiment employs the rack and pinion mechanism for interlinking the gear member and the rack, the present embodiment employs a slit mechanism.

A sheet feed cassette includes a slot 113A, sliders 115 and 121, and a link section 17. The link section 117 has an outside shape as can be obtained by combining two arms together. The link section 117 has slits 118A and 118B in the respective arms. The link section 117 is supported by a rotating shaft 120 extending through the center of a semicircular portion from a lower surface of a sheet support.

The slot 113A is linearly shaped and vertically cut through the sheet support. The slider 115 is joined to a restricting portion provided on an upper surface of the sheet support through the slot 113A and is slidable in the slot 113A with movement of the restricting portion. The slider 115 has a slider pin 116A which is fitted in the slit 118A of the link section 117. As the restricting portion slides, the slider pin 116A slides in the slit 118A of the link section 117 with movement of the slider 115, so that a component of a force exerted by the slider pin 116A on the internal wall of the slit 118A works as a torque to cause the link section 117 to pivot about the rotating shaft 120.

The slot 113B is linearly shaped and vertically cut through the sheet support. The slider 121, which is equivalent to the displacement section defined by the present invention, is slidable in the slot 113B with pivoting movement of the link section 117. The position of the slider 121 is detected by a sensor. The slider 121 has a slider pin 116B which is fitted in the slit 118B of the link section 117. As the link section 117 pivots, the slider pin 116B slides in the slit 118B of the link section 117. The slider 121 is caused to slide in the slot 113B by the slider pin 116B pressed against the inner wall of the slit 118B.

The slit 118B of the link section 117 has a bent shape. Therefore, the distance that the slider travels as the link section 117 pivots through a fixed angle is locally prolonged when the slider pin 116B slides in the vicinity of the tip of the slit 118B.

The slit 118B may be similar to or different from the slit 118A in bending position and angle. It is also possible that the link section is provided with a pin while the slider provided with a slit. The slit may be gently curved.

The foregoing embodiments are illustrative in all points and should not be construed to limit the present invention. The scope of the present invention is defined not by the foregoing embodiments but by the following claims. Further, the scope of the present invention is intended to include all modifications within the scopes of the claims and within the meanings and scopes of equivalents.

What is claimed is:

1. A sheet feeding device comprising:

a sheet support for placing a recording sheet of a standard size thereon;

a restricting section configured to slide along a line passing through at least three restricting points on the sheet support to restrict a position of the recording sheet by abutting against an edge of the recording sheet when the restricting section is positioned at each of the restricting points;

a displacement section provided with the sheet support, a position of the displacement section being detectable by a sensor; and a link section interlinking the restricting section and the displacement section, the link section being configured to move the displacement section in accordance with a position of the restricting section, wherein:

the link section comprises:

a rotating shaft disposed perpendicular to a reverse surface of the sheet support and on a side of a line along which the restricting section slides;

a slit bent in a plane parallel to the reverse surface; and a pinion gear formed with a toothed peripheral surface extending about the rotating shaft;

the restricting section comprising a pin sliding in the slit;

the displacement section comprising a rack gear formed with a toothed surface meshing with the toothed peripheral surface of the pinion gear;

the rotating shaft is disposed in a position where a distance from the rotating shaft to the pin is always longer than a distance from the rotating shaft to the rack gear;

the link section is configured to change a ratio of a distance that the displacement section travels to a distance that the restricting section travels in accordance with a position of the restricting section, the ratio including a first ratio and a second ratio;

the first ratio is a ratio of the distance that the displacement section travels to the distance that the restricting section travels when the restricting section is positioned between restricting points which define a relatively small spacing therebetween;

the second ratio is a ratio of the distance that the displacement section travels to the distance that the restricting section travels when the restricting section is positioned between restricting points which define a relatively large spacing therebetween; and the first ratio exceeds the second ratio.

2. The sheet feeding device according to claim 1, wherein an angle at which a sliding track of the pin crosses the slit when the restricting section travels between the restricting points defining the relatively small spacing therebetween is closer to a right angle than an angle at which a sliding track of the pin crosses the slit when the restricting section travels between the restricting points defining the relatively large spacing therebetween.

3. The sheet feeding device according to claim 1, wherein the slit has a region in which the pin slides when the restricting section travels between the restricting points defining the relatively small spacing therebetween, and a region in which the pin slides when the restricting section travels between the restricting points defining the relatively large spacing therebetween, the regions extending continuously with each other in a bending fashion at an obtuse bending angle.

4. The sheet feeding device according to claim 1, wherein the link section is formed with a rib around the slit.

5. The sheet feeding device according to claim 1, wherein:

the pin includes a large-diameter portion and a small-diameter portion; and the slit has a stepped sectional shape for the large-diameter portion and the small-diameter portion to be fitted therein.

6. The sheet feeding device according to claim 1, wherein the slit mechanism is disposed substantially centrally of the sheet support.

7. The sheet feeding device according to claim 1, wherein:

the sheet support is removably held in a processing apparatus configured to perform processing on the recording sheet; and the position of the displacement section is detected by the sensor located at a position at which the sheet support is held in the processing apparatus.

* * * * *